United States Patent [19]

Replogle

[11] 4,243,244

[45] Jan. 6, 1981

[54] SKI BRAKE

[75] Inventor: Douglas L. Replogle, Amherst, N.Y.

[73] Assignee: Moog Recreational Products, Inc., Wilmington, Del.

[21] Appl. No.: 48,645

[22] Filed: Jun. 14, 1979

Related U.S. Application Data

[63] Continuation-in-part of Ser. No. 9,141, Feb. 5, 1979.

[51] Int. Cl.[3] ..... A63C 5/00

[52] U.S. Cl. ..... 280/605

[58] Field of Search ..... 280/604, 605, 633, 636

[56] References Cited

U.S. PATENT DOCUMENTS

| | | | |
|---|---|---|---|
| 4,116,461 | 9/1978 | Krob et al. | 280/605 |
| 4,171,826 | 10/1979 | Riedel | 280/605 |
| 4,194,758 | 3/1980 | Suoboda et al. | 280/605 |

FOREIGN PATENT DOCUMENTS

| | | | |
|---|---|---|---|
| 2614124 | 10/1976 | Fed. Rep. of Germany | 280/605 |
| 2714175 | 10/1977 | Fed. Rep. of Germany | 280/605 |
| 2711038 | 9/1978 | Fed. Rep. of Germany | 280/605 |

*Primary Examiner*—David A. Scherbel
*Assistant Examiner*—Kenneth Noland
*Attorney, Agent, or Firm*—Sommer & Sommer

[57] ABSTRACT

A ski brake is incorporated in a slide mount for a ski binding component. The slide mount has a rail mounted on the ski, a slide mounted for movement along the rail, and a lever mounted for pivotal movement relative to the rail, and arranged to effect movement of the slide. The slide carries a plunger assembly component of the ski binding. The ski brake includes extensions mounted on the liner for movement therewith, and a torsional spring arranged to urge the lever to move toward a raised position. The torsional spring causes the lever to move to its raised position in the absence of an axial load on the plunger. As the lever moves toward its raised position, the extensions move downwardly below the ski to inhibit free sliding movement of the ski.

5 Claims, 3 Drawing Figures

SKI BRAKE

BACKGROUND OF THE INVENTION

CROSS-REFERENCE TO RELATED APPLICATION

This application is a continuation-in-part of my copending U.S. Patent Application Ser. No. 9,141, filed Feb. 5, 1979, for improvements in a "Slide Mount for a Ski Binding Component".

1. Field of the Invention

The present invention relates generally to the field of ski brakes, and more particularly to an improved ski brake which may be incorporated in a slide mount for a ski binding component.

2. Description of the Prior Art

Upon information and belief, ski brakes have been developed as an alternative to "runaway" cables which tether a ski to the skier's boot.

When a skier falls and separates from his skis, it is generally desired that the detached ski be restrained from freely sliding downhill, away from the skier. To this end, ski brakes have been developed. Desirably, a ski brake should not interfere with normal skiing, but become effective only when the ski separates from the skier's boot.

SUMMARY OF THE INVENTION

The present invention provides a unique improvement in a resiliently-loaded ski binding wherein a boot assembly is releasably secured to a ski by loading means including a first component, such as a detent recess, engageable with a second component, such as a plunger assembly. The ski binding also includes a slide mount for selectively moving one component relative to the other. The slide mount includes a rail mounted on one of the boot assembly and ski and having a channel aligned with the other of the components, a slide carrying such other component and operatively mounted on the rail for movement along the channel relative to the one component, and a lever pivotally mounted on one of the rail and slide and connected to the other of the rail and slide and adapted to be moved between a raised position and a lowered position to move the slide relative to the rail.

The invention provides an improved ski brake mounted on the lever and adapted to prevent unintended travel of the ski after the boot assembly has separated therefrom. The ski brake includes at least one extension mounted on the lever for movement therewith, each extension being configured to extend below the ski when the lever is in its raised position, and resilient means arranged to urge the lever to move toward its raised position.

The resilient means is arranged to sense the pressure of an axial load exerted on the slide, and is operative to cause the lever to move toward its raised position in the absence of such sensed axial load. In the preferred embodiment, the resilient means includes a torsional spring encircling the pivotal axis of the lever and arranged to act between the lever and the rail.

Accordingly, one general object of the present invention is to provide an improved ski brake for preventing a detached ski from sliding downhill from a fallen skier.

Another object is to provide an improved ski brake which may be incorporated in a slide mount for a ski binding component.

Another object is to provide an improved ski brake which is held in an inoperative position by an axial load on a ski binding component, and which becomes operative in the absence of such axial load.

These and other objects and advantages will become apparent from the foregoing and ongoing specification, the drawings, and the appended claims.

DESCRIPTION OF THE PREFERRED EMBODIMENT(S)

Figure 2:
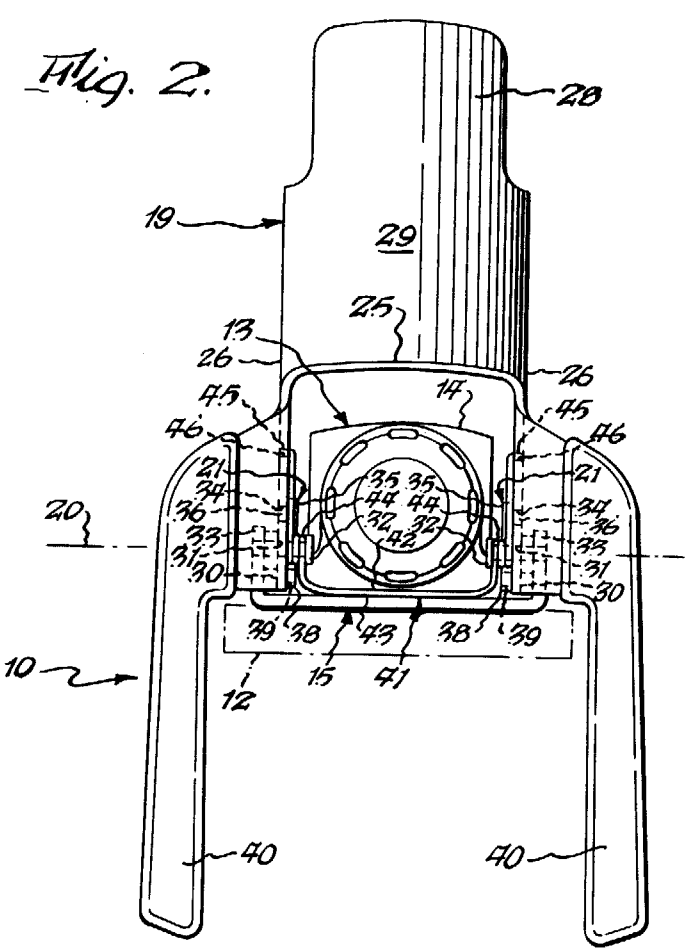
FIG. 2 is a rear elevation thereof.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring now to the several drawing figures, the present invention provides a unique ski brake, generally indicated at 10, for use in a resiliently-loaded ski binding, fragmentarily indicated at 11.

This type of ski binding is generally shown in U.S. Pat. No. 3,921,995, the aggregate disclosure of which is hereby incorporated by reference. The ski binding is adapted to releasably secure a "boot assembly" (not shown) to a ski 12. As used herein, the term "boot assembly" is intended to refer to that structure which remains with the skier when the skier falls and separates from the ski. Such a "boot assembly" may include a boot-sole plate subassembly, as taught in said U.S. Pat. No. 3,921,995, or only the skier's boot.

The illustrated portion of ski binding 11 is shown as including a slide mount, generally indicated at 13, for selectively moving a plunger assembly component 14 axially relative to a detent recess component (not shown). The basic structure of this slide mount 13 is shown and described in my copending U.S. Patent Application Ser. No. 9,141 filed Feb. 5, 1979, entitled "Slide Mount for a Ski Binding Component". The aggregate disclosure of said application Ser. No. 9,141 is hereby incorporated by reference to amplify the description of the structure and operation of slide mount 13, if needed.

Briefly, slide mount 13 includes a rail, generally indicated at 15, mounted on the ski 12, and having a channel aligned with the detent recess (not shown); a slide, generally indicated at 16, carrying a plunger assembly component 18; a lever, generally indicated at 19, mounted on rail 15 for pivotal movement about a horizontal transverse axis 20; and two links 21 operatively connecting the lever and slide.

The plunger assembly component 18 includes a leftwardly-biased plunger 22 slidably mounted in a housing 23. This plunger has a leftward convex nose 24 adapted to be received in the detent recess (not shown).

Figure 3:
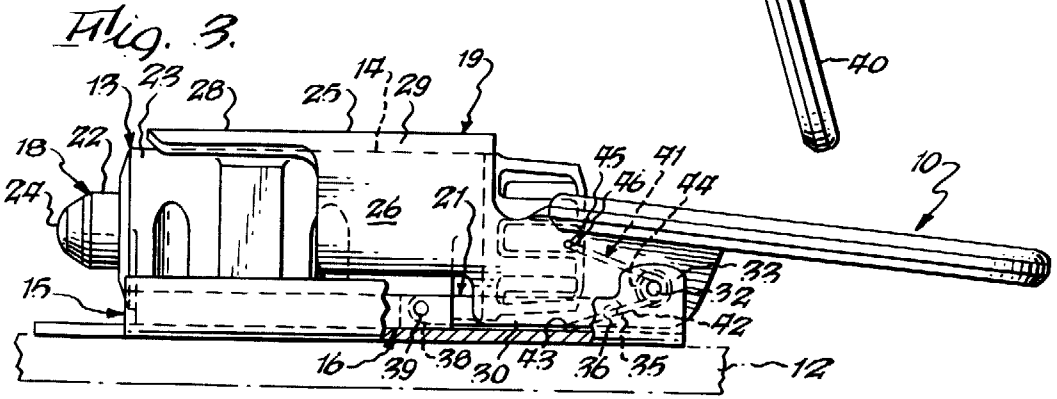
FIG. 3 is a view similar to FIG. 1, but showing the lever as having been moved to its lowered position.

The lever 19 is shown as being a specially-configured member which is adapted to partially embrace the plunger housing when the lever is in the lowered position (FIG. 3). If viewed in transverse cross-section, lever 19 would appear to have a rounded central portion 25 from which two transversely-spaced vertical plates 26, 26 depend. When viewed in side elevation (FIG. 1), the lever is seen as having a distal handle portion 28 formed from the lever rounded portion 25, an intermediate transitional portion 29 formed from the lever upper and plate portions, and two transversely-spaced leg portions 30, 30 formed from the lever plate portions. Adjacent their rearward ends, leg portions 30, 30 are provided with aligned holes 31, 31 to accommodate passage of pivot pins or shafts 32, 32 also penetrating rail raised portions 33, 33. Of course, pivot pins 32, 32 may be retained in these positions by any suitable means. Hence, lever 19 is mounted on the rail for pivotal movement about the axis of aligned pins 32, 32, between a raised position (FIGS. 1 and 2) and a lowered position (FIG. 3). Lever leg portions 30, 30 are provided with another pair of aligned holes 34, 34 for a purpose hereinafter explained.

Figure 1:
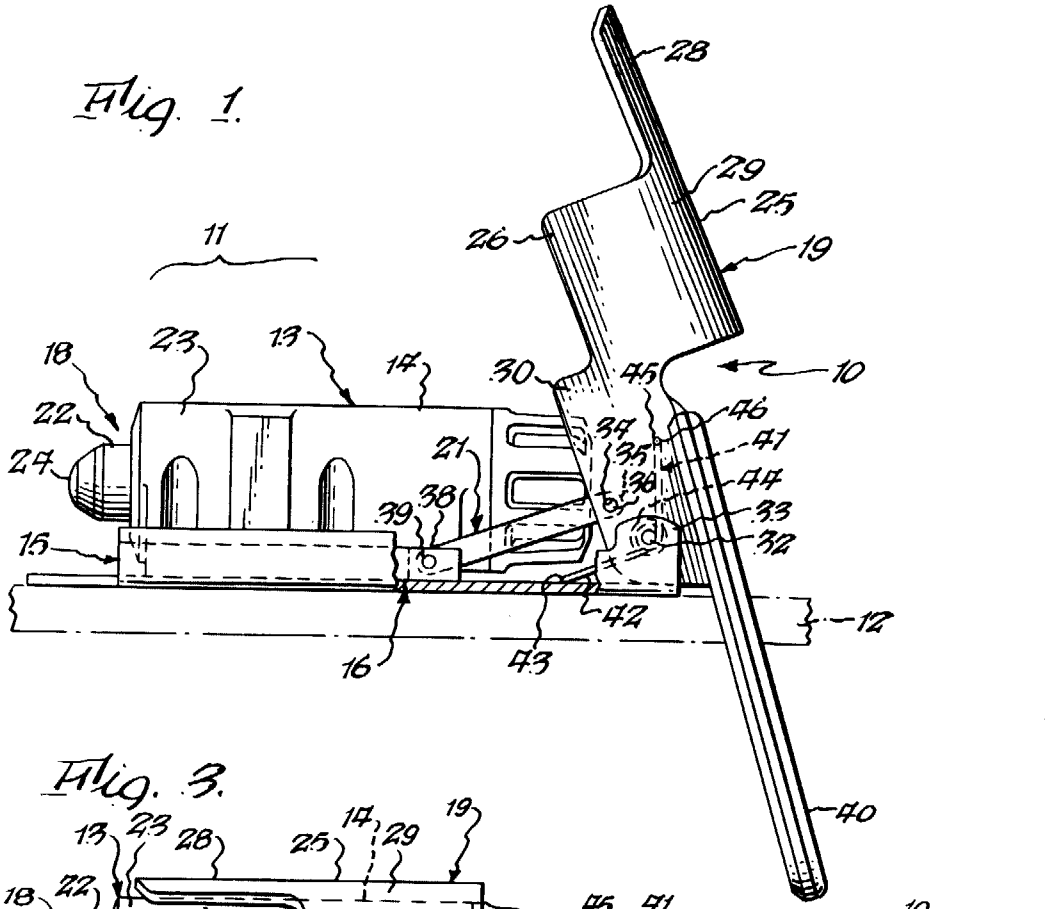
FIG. 1 is a left side elevation of a slide mount for a ski binding component, showing the improved ski brake incorporated therein, this view showing the lever in its raised position.

In the preferred embodiment, two links, severally indicated at 21, operatively connect the lever with the slide. As best shown in FIG. 1, each link has one marginal end portion 35 pivotally connected to the lever, as via a pin 36 passing through the lever leg portion hole 34, and has its opposite marginal end portion 38 pivotally connected to the slide, as by a pivot pin 39. Therefore, pivotal movement of lever 19 about the axis of pins 32, 32 will produce corresponding axial sliding movement of the slide relative to the rail. As the lever is moved toward its lowered position (FIG. 3), this being counterclockwise in FIGS. 1 and 2, the slide and plunger assembly are moved leftwardly toward the detent recess of the boot assembly (not shown). Conversely, when the lever is moved toward its raised position (FIG. 1), the slide and plunger asembly are moved away from the detent recess. It should be noted that the lever-like pins 36, 36 are located above the lever's pivotal axis when the lever is in its raised position, and that such lever link pins are located below the lever's pivotal axis when the lever is in its lowered position. Hence, this configuration provides an "over-center" arrangement such that the normal rearward reaction force exerted by the detent recess on the plunger nose will tend to maintain the lever in its lowered position while a person is skiing.

The improved ski brake 10 is incorporated into the structure of the sliding mount 13, and cooperates therewith to inhibit a detached ski from sliding too far downhill away from the skier.

Specifically, the improved ski brake includes at least one, and preferably two, wing-like extensions 40, 40 mounted on the lever and extending away from the direction of the handle portion 28. When the lever is in its lowered position (FIG. 3), these extensions 40, 40 are arranged above the upper surface of the ski and do not interfere with normal skiing. However, should the lever be moved to its raised position (FIG. 1), these elongated extensions will extend down below the lower surface of the ski to impede and hinder free sliding of the ski away from the fallen skier.

To facilitate such movement of the lever when the skier falls, the improved ski brake further includes resilient means, generally indicated at 41, interposed between the rail and lever and operative to urge the lever to move toward its raised position.

In the preferred embodiment, the resilient means 41 is a torsional spring 42 having an intermediate loop portion 43 engaging the rail (FIG. 2), having several convolutions 44, 44 encircling lever-rail pivot pins 32, 32 and having their inturned distal end portions 45, 45 received in a pair of holes 46, 46 provided in the lever leg portions. Hence, spring 42 is operatively arranged between the rail and lever to urge the lever to move toward its raised position.

It should be noted that the improved ski brake is arranged to sense the presence of an axial load exerted in the plunger nose, and is operative in the absence of such load. The torsion spring 42 continuously urges the lever to move clockwise toward its raised position. When the detent recess engages the plunger nose, the rearward reaction force exerted on the plunger, acting through links 21, 21 at an arm distance from the lever's pivotal axis, overcomes the force exerted by spring and holds the lever in its lowered position. Hence, so long as the detent recess exerts a sufficient rearward reaction force on the plunger, as when the operator is skiing normally, the lever will be maintained in its inoperative lowered position, as shown in FIG. 3. In other words, the presence of a normal axial load on the plunger overcomes the bias of spring 42 and holds the lever in its lowered position.

Should that axial load be removed, as by the skier falling and the "boot assembly" separating from the ski, there will be no force opposing the bias of spring 42. Hence, the spring will cause the lever to move toward its raised position, thereby causing the extensions 40, 40 to pivot down below the lower surface of the ski. In this position, the extensions impede or hinder free sliding movement of the detached ski.

Of course, various changes and modifications may be made. For example, a single pivot shaft may be readily substituted for the two pivot pins connecting the lever and rail. The torsional spring may take many different shapes and forms. Indeed, other types of resilient members and devices may be readily substituted for the torsional spring 42. Needless to say, the shape and configuration of the extensions may be readily varied.

Therefore, while the presently preferred embodiment of the improved ski brake has been shown and described, and several modifications thereof discussed, persons skilled in this art will readily appreciate that various additional changes and modifications may be made without departing from the spirit of the invention, as defined by the following claims.

What is claimed is:

1. In a resiliently-loaded ski binding wherein a boot assembly is releasably secured to a ski by loading means including a first component engageable with a second component, said ski binding including a slide mount for selectively moving one of said components relative to the other of said components, and wherein said slide mount includes a rail mounted on one of said boot assembly and ski and having a channel aligned with the other of said components, a slide carrying the other of said components and operatively mounted on said rail for movement along said channel relative to said one component, and a lever pivotally mounted on one of said rail and slide and connected to the other of said rail and slide and adapted to be moved between a raised position and a lowered position to move said slide relative to said rail, the improvement which comprises:

a ski brake mounted on said lever and adapted to prevent unintended travel of said ski after said boot assembly has separated therefrom, said ski brake including at least one link having one marginal end portion pivotally connected to said lever and having another marginal end portion pivotally connected to said other of said rail and slide, the pivotal connection between said link and lever being below the pivotal axis of said lever when said lever is in said lowered position;

at least one extension mounted on said lever for movement therewith, said extension being configured to extend below said ski when said lever is in said raised position; and resilient means arranged to urge said lever to move toward said raised position.

2. The improvement as set forth in claim 1 where said resilient means is operatively arranged to sense the presence of an axial load exerted by one component on the other component.

3. The improvement as set forth in claim 2 wherein said resilient means is arranged to cause said lever to move to said raised position in the absence of such sensed axial load.

4. The improvement as set forth in claim 1 wherein said resilient means includes a torsional spring encircling the pivotal axis of said lever and arranged to act between said lever and rail.

5. The improvement as set forth in claim 1 wherein the pivotal connection between said link and lever is located above the pivotal axis of said lever when said lever is in said raised position.

* * * * *